US007070480B2

(12) United States Patent
Moon et al.

(10) Patent No.: US 7,070,480 B2
(45) Date of Patent: Jul. 4, 2006

(54) METHOD AND APPARATUS FOR POLISHING SUBSTRATES

(75) Inventors: Yongsik Moon, San Mateo, CA (US); Kapila Wijekoon, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 214 days.

(21) Appl. No.: 10/269,107

(22) Filed: Oct. 10, 2002

(65) Prior Publication Data

US 2003/0114084 A1 Jun. 19, 2003

Related U.S. Application Data

(60) Provisional application No. 60/328,434, filed on Oct. 11, 2001.

(51) Int. Cl.
*B24B 1/00* (2006.01)

(52) U.S. Cl. ..... 451/36; 451/527; 451/41

(58) Field of Classification Search ..... 451/36, 451/354, 526, 528, 529, 41, 285–289, 443, 451/527, 530; 156/345
See application file for complete search history.

(56) References Cited

U.S. PATENT DOCUMENTS

| | | | | |
|---|---|---|---|---|
| 5,014,468 | A | 5/1991 | Ravipati et al. | |
| 5,527,215 | A | 6/1996 | Rubino et al. | 451/527 |
| 5,551,960 | A * | 9/1996 | Christianson | 51/295 |
| 5,578,362 | A | 11/1996 | Reinhardt et al. | |
| 5,692,950 | A | 12/1997 | Rutherford et al. | 451/552 |
| 5,820,450 | A * | 10/1998 | Calhoun | 451/530 |
| 5,899,799 | A | 5/1999 | Tjaden et al. | 451/287 |
| 5,921,855 | A | 7/1999 | Osterheld et al. | 451/527 |
| 5,958,794 | A | 9/1999 | Bruxvoort et al. | 438/692 |
| 5,990,012 | A | 11/1999 | Robinson et al. | 438/692 |
| 6,019,666 | A | 2/2000 | Roberts et al. | 451/36 |
| 6,069,080 | A | 5/2000 | James et al. | 438/691 |
| 6,121,143 | A | 9/2000 | Messner et al. | 438/692 |
| 6,159,088 | A | 12/2000 | Nakajima | 451/527 |
| 6,186,866 | B1 | 2/2001 | Gagliardi | |
| 6,217,426 | B1 | 4/2001 | Tolles et al. | 451/285 |
| 6,238,271 | B1 | 5/2001 | Cesna | 451/41 |
| 6,346,032 | B1 * | 2/2002 | Zhang et al. | 451/41 |
| 6,350,180 | B1 * | 2/2002 | Southwick | 451/41 |

(Continued)

FOREIGN PATENT DOCUMENTS

JP 06047678 2/1994

(Continued)

OTHER PUBLICATIONS

European Search Report for EP 00 31 1062 dated Aug. 11, 2003 (AMAT/3778.EP).

*Primary Examiner*—Lee D. Wilson
(74) *Attorney, Agent, or Firm*—Moser, Patterson & Sheridan

(57) ABSTRACT

Method and apparatus for polishing substrates. A chemical mechanical polishing article comprises a body and a patterned surface. The patterned surface comprises a plurality of slurry distribution grooves and a plurality of islands on the body. Each of the plurality of the islands comprises a base portion, a polishing surface disposed thereon, and a contoured surface disposed therebetween. The base portion comprises one or more sidewalls defining at least a portion of the plurality of slurry distribution grooves. The polishing surface is smaller than the base portion, the difference therebetween attributable to the contoured surface. In a particular embodiment, conductive materials and low k dielectric films are polished with reduced or minimum substrate surface damage.

13 Claims, 8 Drawing Sheets

U.S. PATENT DOCUMENTS

| | | | | |
|---|---|---|---|---|
| 6,439,986 | B1 * | 8/2002 | Myoung et al. | 451/443 |
| 6,544,373 | B1 * | 4/2003 | Chen et al. | 156/252 |
| 6,562,182 | B1 * | 5/2003 | Agarwal | 257/1 |
| 6,604,985 | B1 | 8/2003 | Muilenburg et al. | |
| 6,632,129 | B1 * | 10/2003 | Goetz | 451/533 |
| 2002/0077037 | A1 | 6/2002 | Tietz | |
| 2002/0102853 | A1 | 8/2002 | Li et al. | 438/692 |
| 2002/0111120 | A1 * | 8/2002 | Goetz | 451/41 |
| 2003/0003857 | A1 * | 1/2003 | Shimagaki et al. | 451/534 |

FOREIGN PATENT DOCUMENTS

| | | |
|---|---|---|
| JP | 11216663 | 8/1999 |
| WO | 00 59662 | 10/2000 |
| WO | 00/71297 | 11/2000 |

* cited by examiner

METHOD AND APPARATUS FOR POLISHING SUBSTRATES

CROSS-REFERENCE TO RELATED APPLICATIONS

This application claims benefit of U.S. provisional patent application Ser. No. 60/328,434, filed Oct. 11, 2001, which is herein incorporated by reference.

BACKGROUND OF THE INVENTION

1. Field of the Invention

The present invention relates to substrate processing. More particularly, the invention relates to substrate polishing.

2. Background of the Related Art

In the fabrication of integrated circuits and other electronic devices, multiple layers of conducting, semiconducting and dielectric materials are deposited and removed from a substrate during the fabrication process. Often it is necessary to polish a surface of a substrate to remove high topography, surface defects, scratches or embedded particles. One common polishing process is referred to as chemical mechanical polishing (CMP) and is used to improve the quality and reliability of the electronic devices formed on the substrate.

In one example of a polishing process, a substrate is rotated in a substrate support and contacted against a polishing article under controlled pressure, temperature and rotational speed (velocity) of the polishing article in the presence of a chemical slurry or other fluid medium to remove materials from a substrate surface, such as dielectric or conductive materials. The provision of slurry facilitates higher removal rates of deposited films.

An important goal of CMP is achieving uniform planarity of the substrate surface. Uniform planarity includes the uniform removal of material deposited on the surface of substrates as well as removing non-uniform layers that have been deposited on the substrate. One measure of uniformity is referred to as "with-in-substrate non-uniformity" (WIWNU). With-in-substrate non-uniformity refers to the ability of the CMP apparatus to remove features across the diameter of the substrate regardless of substrate shape and/or topography across its surface. Another measure of uniformity is referred to as "with-in-die non-uniformity" (WIDNU), which refers to the ability of the CMP apparatus to remove features within a die, regardless of size and feature density. Successful CMP also requires achieving an acceptable level of WIWNU and WIDNU for a given substrate as well as repeatability from one substrate to the next.

In addition to uniformity, other process parameters that must be controlled include the removal rate and structural defects. Removal rate refers to the rate at which material is removed from a wafer during polishing and is measured in angstroms per minute. In general, a higher removal rate is preferred in order to increase throughput (i.e., the number of wafers processed per unit time). Structural defects refer to undesirable surface defects on the wafer such as dishing, erosion, peeling and delamination.

The various consumables of CMP (e.g., the polishing article and slurry) each affect the ability to control the processing parameters described above (i.e., uniformity, removal rate and structural defects) of polished substrates. As a result, characteristics of the polishing article and slurry have been extensively studied and controlled in an effort to achieve a desired result. For example, it is known that the sufficiency of slurry (i.e., slurry volume and rate of slurry replenishment) and uniformity of slurry over the substrate surface directly impact the processing parameters. Regions of insufficient or relatively non-uniform slurry are referred to as "starved" regions. In these starved regions, the removal rate may be different than in other regions of the substrate, resulting in non-uniformity of the substrate topography.

To ensure the sufficiency and uniformity of slurry delivery, various polishing article designs have been utilized. Specifically, the polishing surfaces of polishing articles are patterned with grooves to allow for slurry flow therein. Two common groove designs are shown in FIGS. 1 and 2, respectively. FIG. 1 shows a polishing article 100 with plurality of grooves 102 arranged concentrically about a central axis 104 of the polishing article 100. Such grooves are commonly referred to as k-grooves. FIG. 2 shows a polishing article 200 with a plurality of grooves 202 arranged in a crosswise manner, often referred to as XY grooves.

FIG. 3 shows a cross-section of a groove 302 formed in a polishing article 300. The groove 302 may be representative of either of the grooves 102 and 202. In general, the groove 302 is defined by a bottom 306 and a pair of sidewalls 308. The sidewalls are vertically inclined and generally orthogonal to the floor 306 and an upper polishing surface 310. The sidewalls 308 and the upper polishing surface 310 meet to define corners 304.

One problem with conventional grooved polishing articles is that the corners 304 can produce undesirable effects. Specifically, the corners act as a knife edge against the wafer being polished, resulting in delamination and/or peeling of material from the wafer. This phenomenon is illustrated with respect to FIG. 4. FIG. 4 shows the polishing article 300 described above with reference to FIG. 3.

A wafer 400 is shown disposed on the polishing surface 310. During polishing, a downward pressure is applied to the wafer 400 with respect to the polishing article 300, thereby at least partially compressing the polishing article 300. The amount of compression is indicated by a distance D between the compressed polishing surface 310 and the uncompressed polishing surface 310. In addition, the wafer 400 and the polishing article 300 are rotated relative to one another while the wafer 400 is moved laterally over the surface of the polishing article 300, as indicated by the horizontally oriented arrow (indicating velocity). As a result, an edge 402 of the wafer 400 will periodically encounter a corner 304 of an uncompressed portion of the polishing article 310. The resulting contact between the edge 402 and the corners 304 can damage portions of the wafer 400, primarily at the edge 402. The detrimental cutting effected by the corners 304 is particularly severe where XY grooves are used. This is because, in addition to forming sharp or "knife" edges, the intersections of the XY grooves form points, which are particularly destructive to the material disposed on the wafer.

Therefore, there is a need for a polishing article that mitigates damage to wafers.

SUMMARY OF THE INVENTION

Aspects of the invention relate generally to methods and apparatus for polishing substrates with reduced or minimum substrate surface damage.

In one embodiment, a polishing article is provided comprising a body having a patterned surface. The patterned surface comprises a plurality of raised upper polishing areas, a recessed area defined by the plurality of raised upper polishing areas, and a contoured surface disposed at a perimeter of and extending from each of the plurality of raised upper polishing areas.

Another embodiment provides a chemical mechanical polishing article, comprising a body and a patterned surface comprising a plurality of slurry distribution grooves and a plurality of the islands on the body. Each of the plurality of the islands comprises an upper polishing surface, a sidewall defining at least a portion of the plurality of slurry distribution grooves, and a contoured surface disposed between the upper polishing area and the sidewall.

In yet another embodiment, the plurality of the islands each comprise a base portion and a tip portion disposed on the base. The base portion comprises a sidewall defining at least a portion of the plurality of slurry distribution grooves and the tip portion has a decreasing diameter from the base portion to an upper polishing surface.

In still another embodiment, a method of polishing materials disposed on a substrate is provided. The method comprises rotating a chemical mechanical polishing article comprising a patterned surface, contacting the patterned surface with material disposed on the substrate, and removing at least a portion of the material. Illustratively, the patterned surface comprises a plurality of slurry distribution grooves and a plurality of the islands on the body, wherein each of the plurality of the islands comprises a base portion comprising a sidewall defining at least a portion of the plurality of slurry distribution grooves and a tip portion disposed on the base portion and having a decreasing width from the base portion to an upper polishing surface.

BRIEF DESCRIPTION OF THE DRAWINGS

So that the manner in which the above recited aspects of the invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

In general, aspects of the invention provide methods and apparatus for polishing substrates. In a particular embodiment conductive materials and low k dielectric films are polished with reduced or minimum substrate surface damage and peeling. Embodiments of the invention will be described below with reference to chemical mechanical polishing (CMP) techniques. Chemical mechanical polishing is broadly defined herein as polishing a substrate by a combination of both chemical and mechanical activity. However, any polishing technique is contemplated as an embodiment. For example, the embodiments of the present invention may be used in electropolishing systems. Further, the particular mechanical activity employed is not limited to a particular method. Thus, any relative motion between a polishing article and a substrate may be used. Illustrative relative motions include relative rotational motion, relative linear motion and intermittent motion.

A planarization process can be carried out using chemical mechanical polishing process equipment, including linear and orbital polishers. One system which may be used to advantage is the Mirra® CMP System available from Applied Materials, Inc., of Santa Clara, Calif., as shown and described in U.S. Pat. No. 5,738,574, entitled, "Continuous Processing System for Chemical Mechanical Polishing," the entirety of which is incorporated herein by reference to the extent not inconsistent with the invention. Another system that can be used to advantage is a linear polishing apparatus, such as the Reflexion™ CMP System available from Applied Materials, Inc., of Santa Clara, Calif. The following apparatus description is illustrative and should not be construed or interpreted as limiting the scope of the invention.

Additionally, while the apparatus describes a polishing article on a rotating platen polishing apparatus, the invention also contemplates the use of other suitable apparatuses including orbital polishing systems, such as the Model 8200C Polishing System available from Applied Materials, Inc., of Santa clara, Calif., or a linear platen polishing system, using a sliding or circulating polishing belt or similar device, with the linear platen capable of rotatable motion and/or linear motion. An example of a linear polishing system is more fully described in co-pending U.S. patent application Ser. No. 09/244,456, filed on Feb. 4, 1999, and incorporated herein by reference to the extent not inconsistent with the invention.

Figure 5:
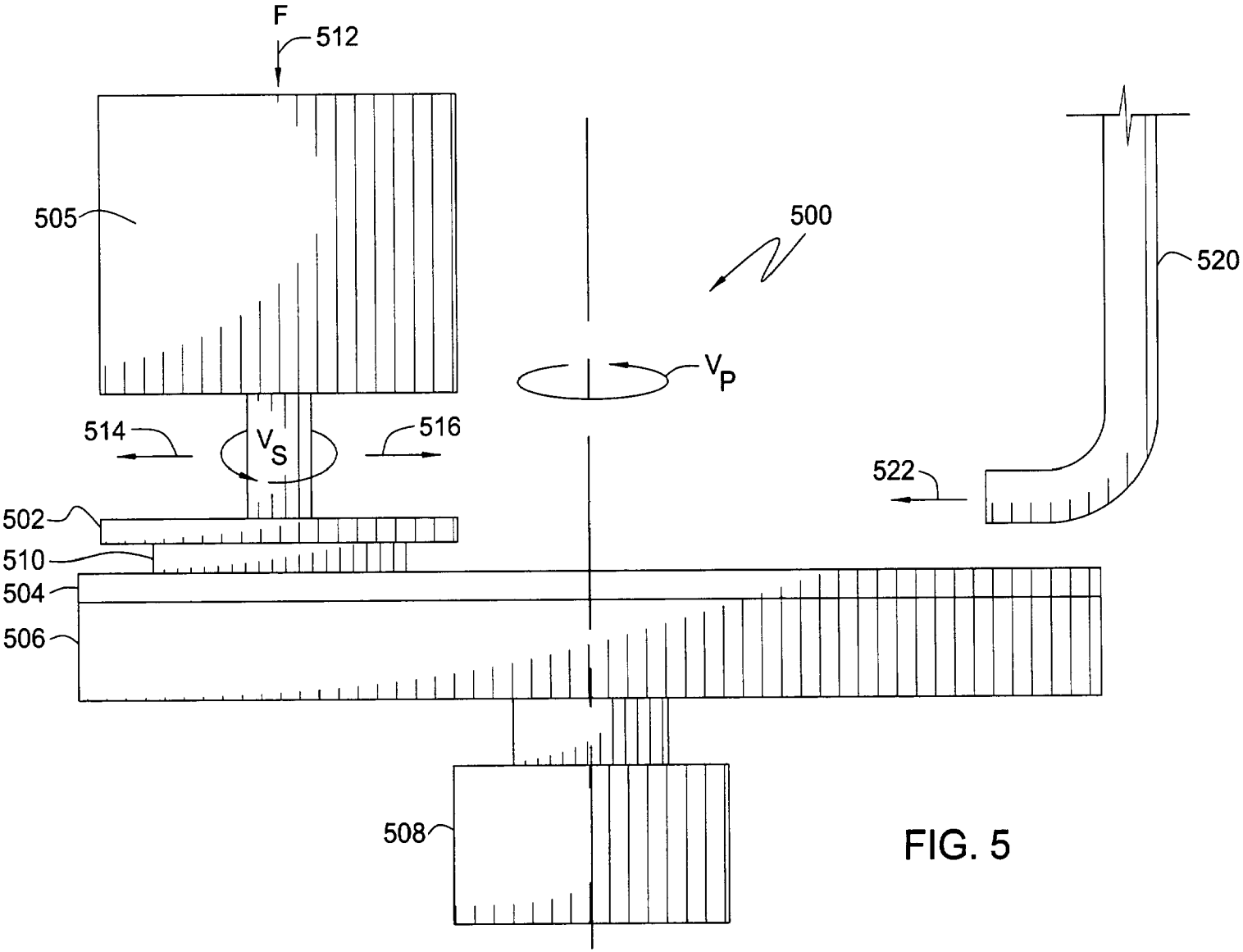
FIG. 5 is a schematic perspective view of a chemical mechanical polishing apparatus.

FIG. 5 is a schematic view of one embodiment of a polishing station and polishing head used to advantage with the present invention. The polishing station 500 comprises a polishing article 504 secured to an upper surface of a rotatable platen 506. The polishing article 504 is preferably made of a plastic or foam such as polyurethane (including microporous polyurethane or polyurethane mixed with filler), but other materials known and unknown may be used. In particular, the polishing article material may be selected according to a desired degree of rigidity and compliance.

The polishing article 504 may include fixed abrasive polishing articles containing abrasive particles, such as silica or ceria in a polymeric binder, such as fixed abrasive polishing article, for example, as the structured abrasive belts available under part numbers 3M 307EA or 3M 237AA, available from 3M Corporation of St. Paul, Minn.

The polishing article 504 may include conventional polishing article material, such as urethane or polyurethane materials or felt leeched with urethane, for example, material used in the IC-1000 and Suba IV polishing pads commercially available from Rodel Inc., of Phoenix Ariz. The polishing article 504 may also be a conductive material or a conductive polishing article adapted with the grooves and/or raised areas or features described herein. An example of a conductive polishing article is disclosed in U.S. patent application Ser. No. 10/033,732, filed on Dec. 27, 2001, which is incorporated herein by reference to the extent not inconsistent with the disclosure and claimed aspects herein. The polishing article may be in the shape of a circular polishing pad or a linear polishing article, also know as a polishing belt.

Although shown here as a single layer polishing article, it is understood that in other embodiments the polishing article 504 may be a composite polishing article comprising multiple layers, for example a layer of IC-1000 material disposed on a layer of Suba IV material, or a linear belt comprising a soft cushion layer and a polishing layer. The polishing article 504 may be perforated (channels for flow of polishing compositions or electrolyte solutions therethrough. Perforation should be broadly construed and includes, but is not limited to, an aperture, hole, opening, void, channel, or passage formed partially or completely through an object, such as a polishing article.

The platen 506 is coupled to a motor 508 or other suitable drive mechanism to impart rotational movement to the platen 506. During operation, the platen 506 is rotated at a velocity $V_p$ about a center axis X. The platen 506 can be rotated in either a clockwise or counterclockwise direction.

FIG. 5 also shows the polishing head 502 mounted above the polishing station 500. The polishing head 502 supports a substrate 510 for polishing. The polishing head 502 may comprise a vacuum-type mechanism to chuck the substrate 510 against the polishing head 502. During operation, the vacuum chuck generates a negative vacuum force behind the surface of the substrate 510 to attract and hold the substrate 510. The polishing head 502 typically includes a pocket (not shown) in which the substrate 510 is supported, at least initially, under vacuum. Once the substrate 510 is secured in the pocket and positioned on the polishing article 504, the vacuum can be removed. The polishing head 502 then applies a controlled pressure behind the substrate, indicated by the arrow 512, to the backside of the substrate 510 urging the substrate 510 against the polishing article 504 to facilitate polishing of the substrate surface. The polishing head displacement mechanism 505 rotates the polishing head 502 and the substrate 510 at a velocity $V_s$ in a clockwise or counterclockwise direction, preferably the same direction as the platen 506. The polishing head displacement mechanism 505 also preferably moves the polishing head 502 radially across the platen 506 in a direction indicated by arrows 514 and 516.

With reference to FIG. 5, the CMP system also includes a chemical supply system 520 for introducing a chemical slurry of a desired composition to the polishing article 504. In some applications, the slurry provides up to about 35 wt. % of an abrasive material that facilitates the polishing of the substrate surface, and the abrasive materials may comprise, for example, alumina, silica, or ceria. The slurry may also be free of abrasive particles, which are preferably used with fixed-abrasive polishing articles. During operation, the chemical supply system 520 introduces the slurry, as indicated by arrow 522, on the polishing article 504 at a selected rate. In other applications the polishing article 504 may have abrasive particles disposed thereon and require only that a liquid, such as deionized water, be delivered to the polishing surface of the polishing article 504.

Figure 6:
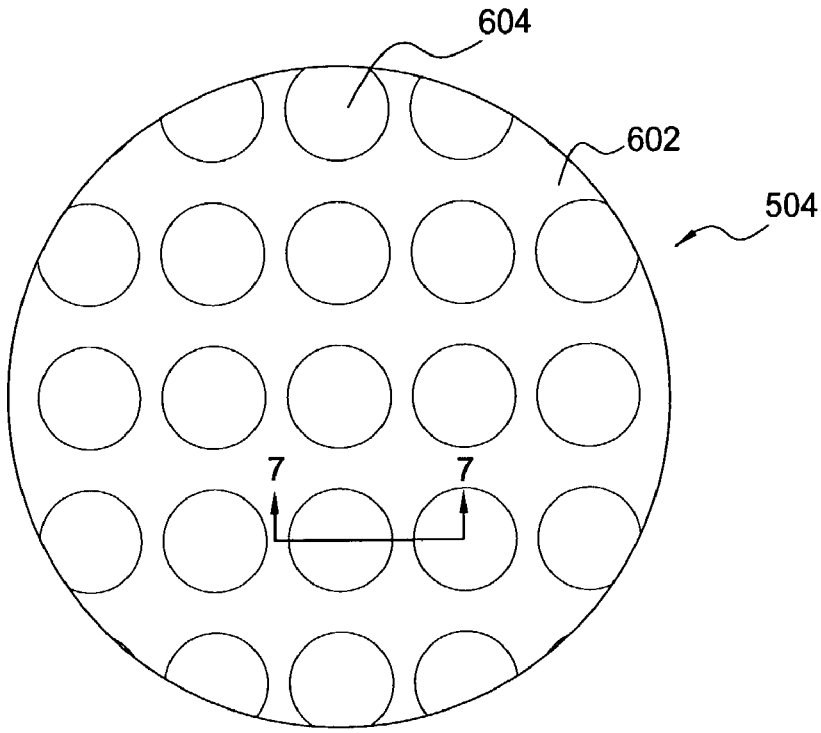
FIG. 6 is a top view of a patterned polishing article.

In one embodiment, the polishing article 504 provides a patterned polishing surface for controlling the flow of a fluid such as slurry or deionized water. FIG. 6 shows a top view of one embodiment of the polishing article 504 having a patterned surface formed thereon. The patterned surface of the polishing article 504 is defined by a plurality of grooves 602 (or recessed area) forming a plurality of islands 604 (or raised area). Islands 604 can include raised features formed on a polishing article 504, such as fixed abrasive posts for circular or linear polishing articles.

Figure 2:
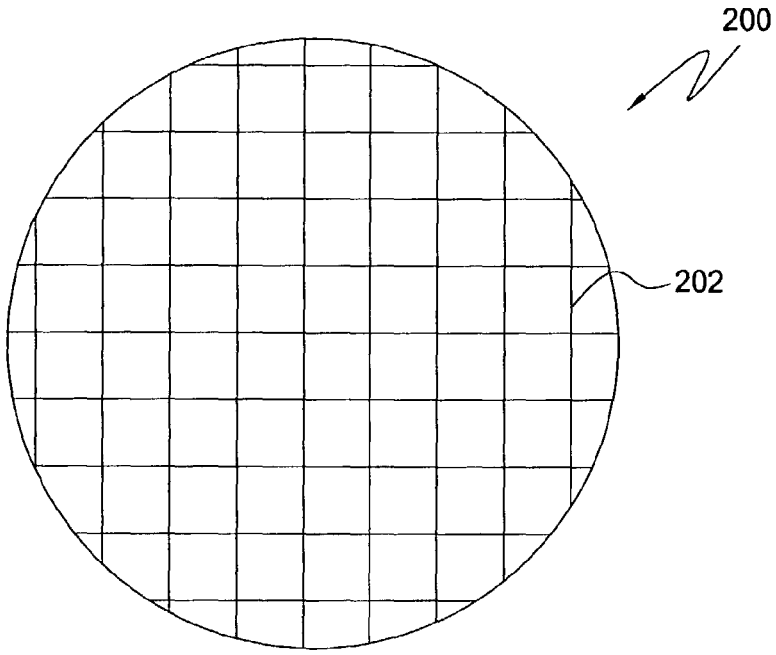
FIG. 2 (PRIOR ART)
FIG. 2 is a top view of a prior art grooved polishing article.
Figure 3:
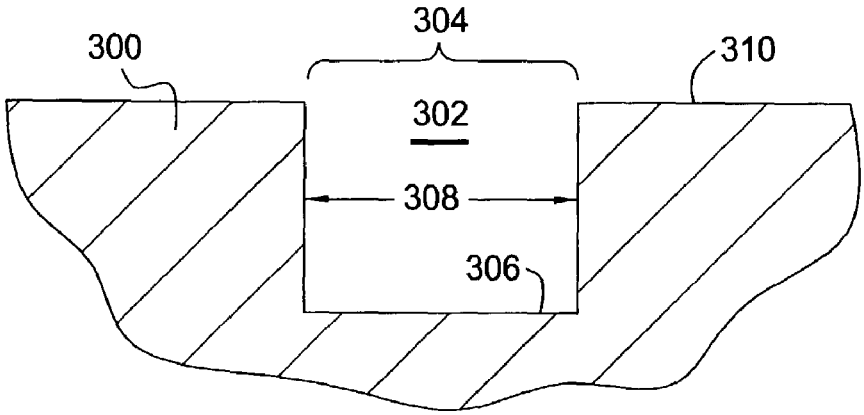
FIG. 3 (PRIOR ART)
FIG. 3 is a cross-sectional view of a prior art grooved polishing article.
Figure 4:
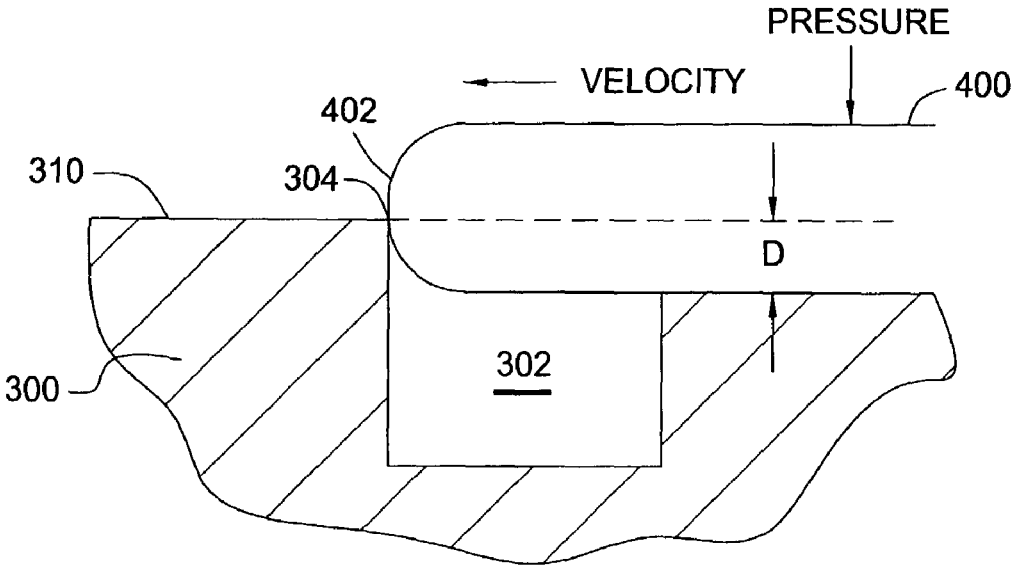
FIG. 4 (PRIOR ART)
FIG. 4 is a cross-sectional view of a prior art grooved polishing article having a wafer disposed thereon.
Figure 12:
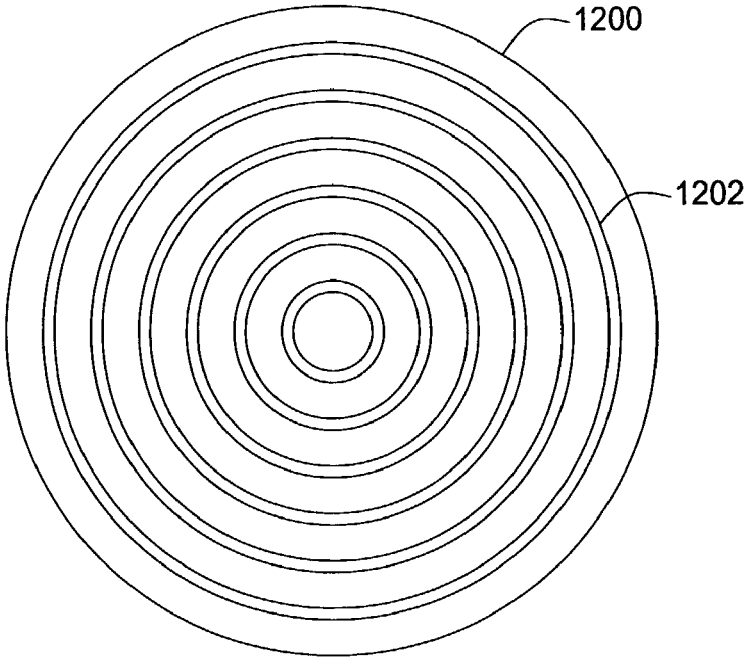
FIG. 12 is a top view of a polishing article having concentric grooves.
Figure 13:
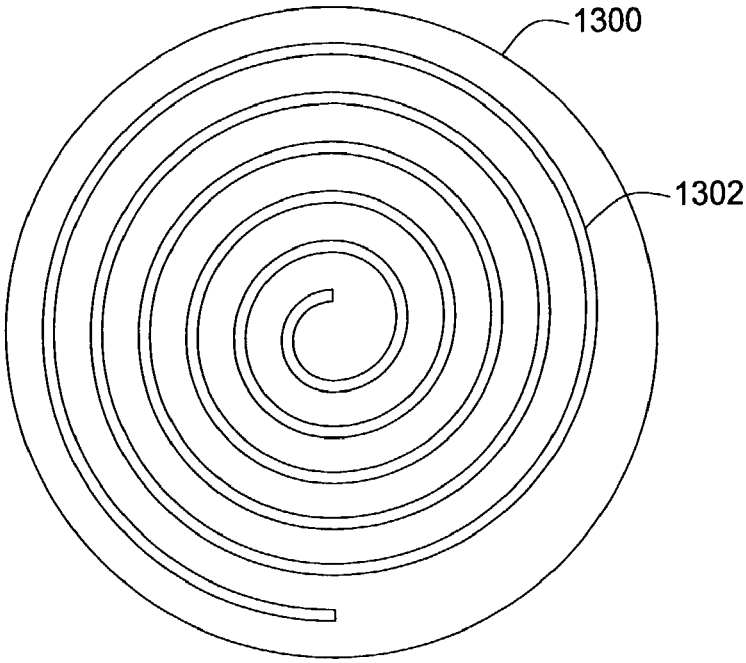
FIG. 13 is a top view of a polishing article having a spiraling groove.
Figure 14:
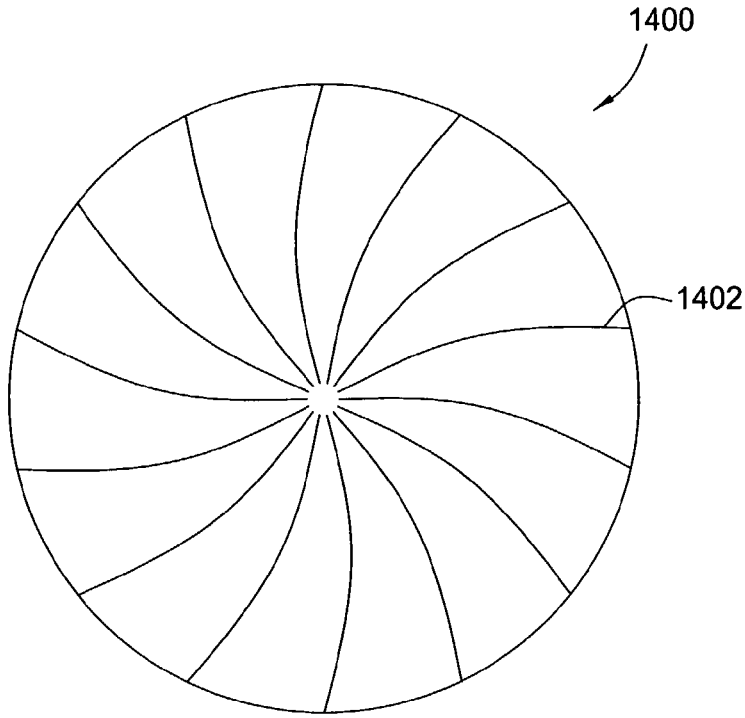
FIG. 14 is a top view of a polishing article having serpentine grooves.
Figure 15:
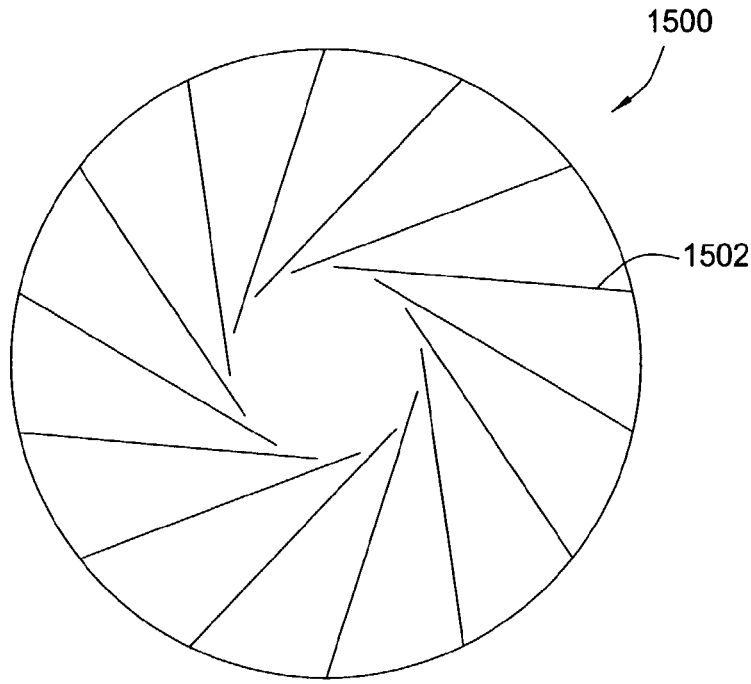
FIG. 15 is a top view of a polishing article having turbine grooves.

Illustratively, the islands have a circular shape. More generally, however, the islands 604 and grooves 602 may have any orientation and shape, such as a polygonal shape. For example, the grooves 602 may be concentric circles, spirals, serpentine, turbine or XY grooves. An example of XY grooves is shown in FIG. 2. An example of one embodiment of a polishing article 1200 having concentric circle grooves 1202 is shown in FIG. 12. An example of one embodiment of a polishing article 1300 having a spiraling groove 1302 is shown in FIG. 13. An example of one embodiment of a polishing article 1400 having serpentine grooves 1402 is shown in FIG. 14. An example of one embodiment of a polishing article 1500 having turbine grooves 1502 is shown in FIG. 15.

Figure 7:
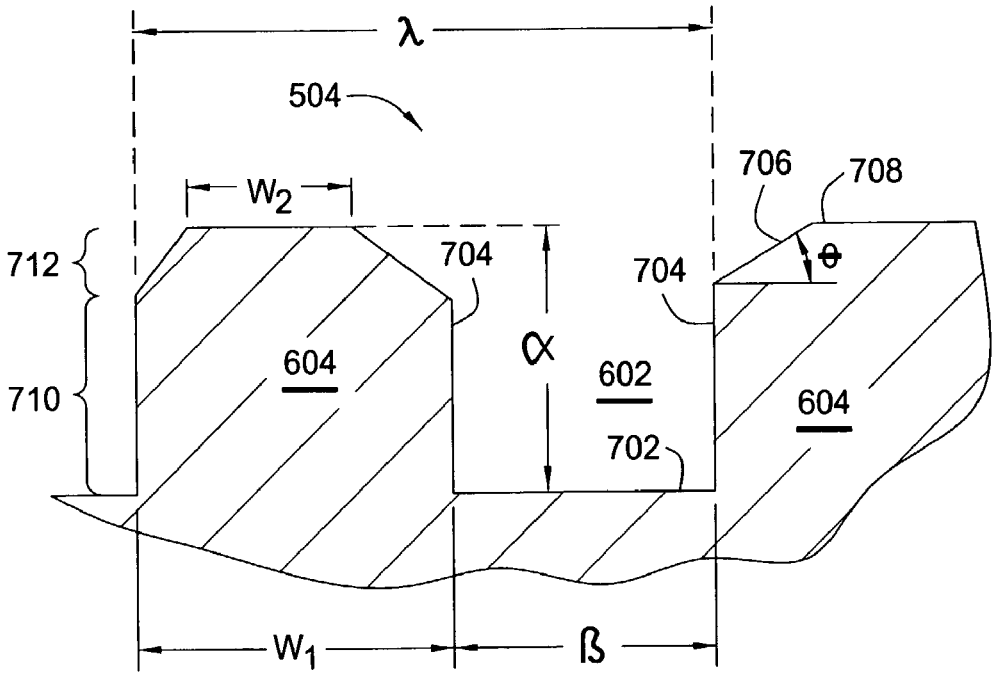
FIG. 7 is a cross-sectional view of a patterned polishing article.

FIG. 7 is a cross-sectional view of the polishing article 504 taken at section lines 7—7 showing one embodiment of the groove 602 and the island 604. The groove 602 is defined by a bottom 702 and two sidewalls 704. While the sidewalls 704 are shown here as substantially parallel relative to one another, in other embodiments the sidewalls 704 may have other geometric shapes. The grooves 602 have a depth $\alpha$ and a width $\beta$. Although variable, in one embodiment the depth $\alpha$ is between about 15 mils and about 30 mils and the width $\beta$ is between about 10 mils and about 80 mils when the total polishing article thickness is between about 50 mils and about 80 mils. Further, the grooves 602 may have a pitch $\lambda$ between about 60 mils and about 600 mils. It is understood that the foregoing dimensions are merely illustrative and persons skilled in the art may recognize other suitable dimensions within the scope of the invention.

Each embodiment of the polishing article 504 comprises a contoured surface on portions of the pattered surface. More specifically, the contoured surfaces are preferably located on a tip portion of the islands 604, where the tip portions are disposed on a base portion of the islands 604. For example, FIG. 7 shows an island 604 comprising a base portion 710 and a tip portion 712. The island 604 has an inclined surface 706 defined on the tip portion 712 between an upper polishing surface 708 and the sidewalls 704. Accordingly, the islands 604 define a first width W1 at the base portion 710, then taper inwardly along the inclined surface 706 of the tip portion 712, and define a second width W2 at an upper polishing surface 708. The inclined surface 706 defines an angle $\theta$ relative to a plane parallel to the upper polishing surface 708. In general, the angle $\theta$ may be selected to avoid or minimize damage to the wafer, such as between about 30° and about 60°, for example about 45°.

Further, is contemplated that the sidewalls 704 may be altogether eliminated such that the incline 706 extends from the upper polishing surface 708 to the bottom 702.

Figure 8:
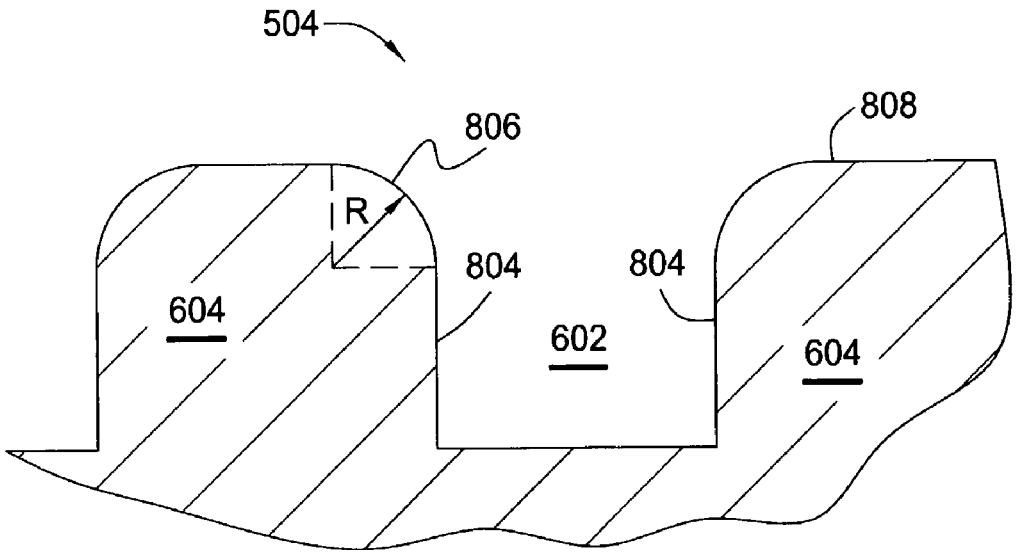
FIG. 8 is a cross-sectional view of a patterned polishing article.

In another embodiment, shown in FIG. 8, the islands 604 are formed with tapered, or rounded, surfaces 806 between an upper polishing surface 808 and the sidewalls 804. The curvature of the tapered surfaces 806 may be defined by a radius R, in the case where the tapered surfaces 806 are defined by an arc length of a circle. In one embodiment, the radius is selected according to the wafer thickness. For example, in one embodiment, the radius R may be at least as long as half of the wafer thickness. In other embodiments, the tapered surfaces 806 need not have a uniform curvature. Thus, the rate at which the slope of the tapered surface 806 changes with respect to length, may vary. For example, the tapered surface 806 may have a relatively slowly increasing slope nearer the upper polishing surface 808 and a relatively quickly increasing slope nearer the sidewalls 804.

Figure 1:
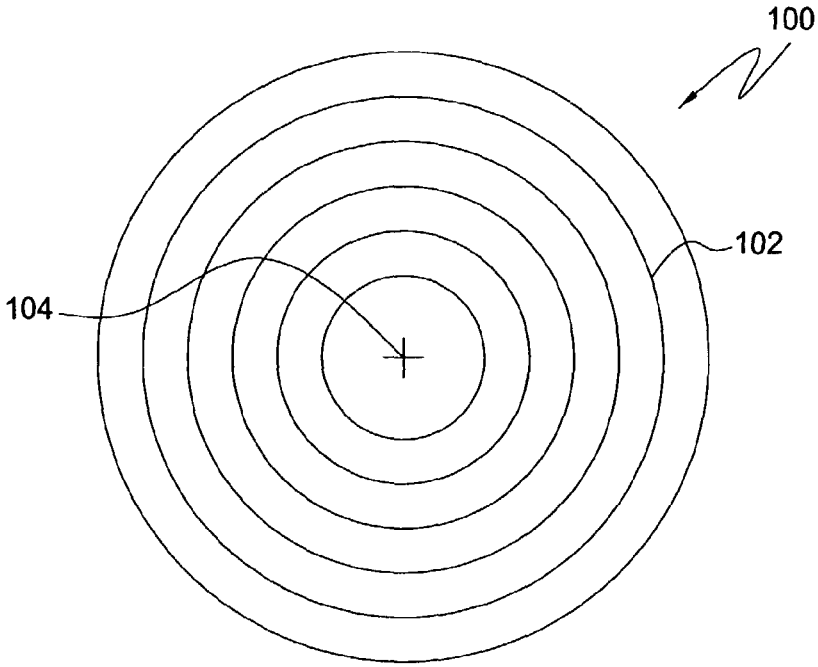
FIG. 1 (PRIOR ART)
FIG. 1 is a top view of a prior art grooved polishing article.
Figure 9:
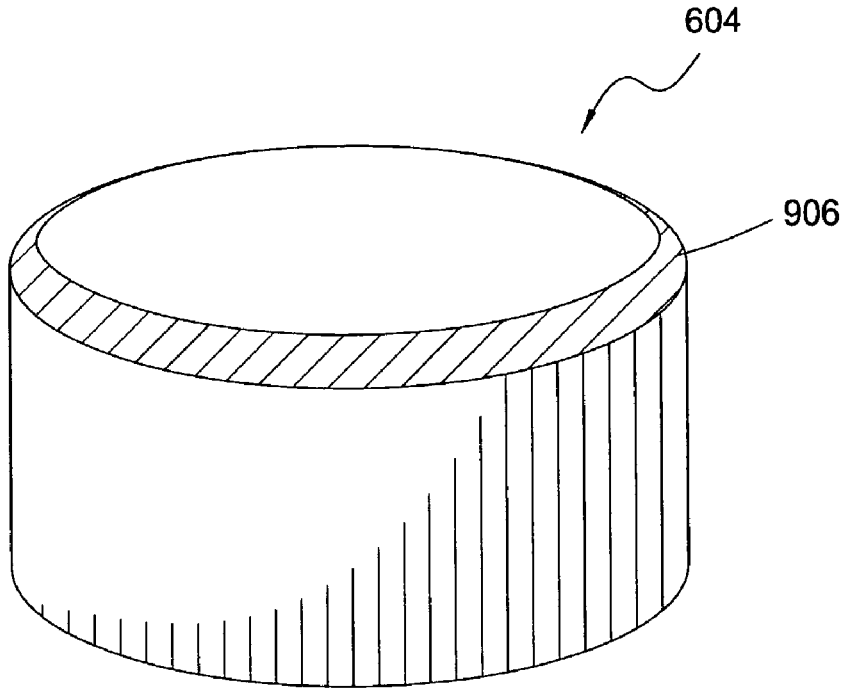
FIG. 9 is a perspective view of an island of patterned polishing article.
Figure 10:
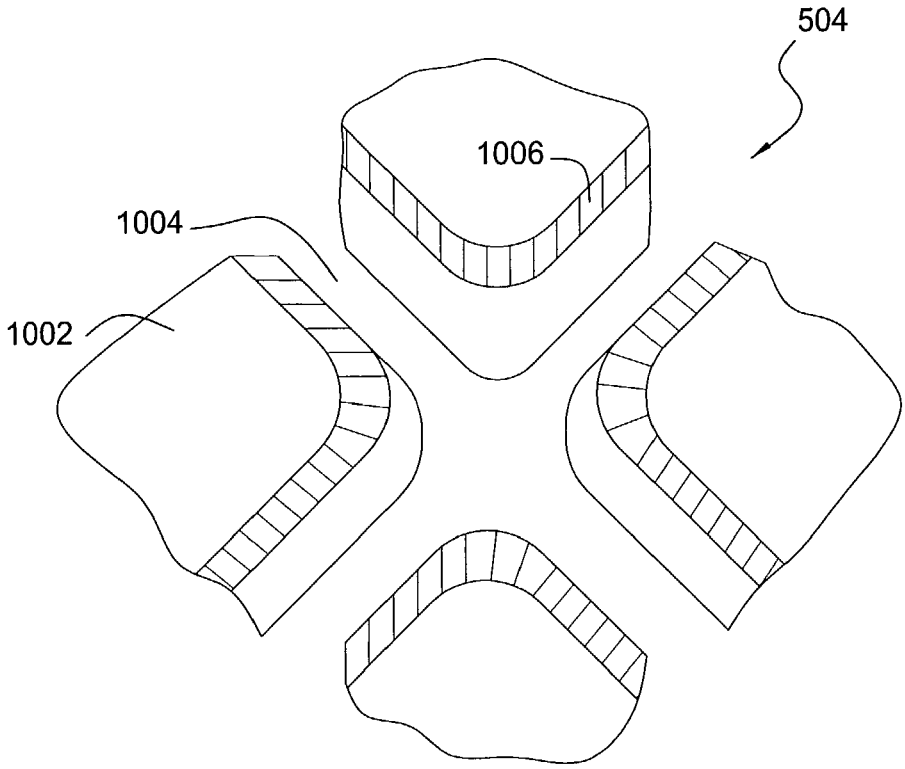
FIG. 10 is a perspective view of the intersection of four islands of an XY patterned polishing article having discrete contoured surfaces at the corners of the islands.

In general, the contoured surfaces of the polishing article 504 may be continuous about the islands 604 or may be discrete areas on the islands 604. For example, FIG. 9 shows a perspective view of one embodiment of an island 604 in which an inclined surface 906 is continuous about the perimeter of the island. FIG. 10 shows another embodiment in which the contoured surface is continuous about the perimeter of islands 1002. Specifically, FIG. 10 shows an XY groove embodiment of the polishing article 504, such as the one shown in FIG. 1, in which the pattern of the polishing article 504 is defined by a plurality of substantially square islands 1002 separated by grooves 1004. Each island 1002 is patterned with a contoured surface 1006 extending about its perimeter.

Figure 11:
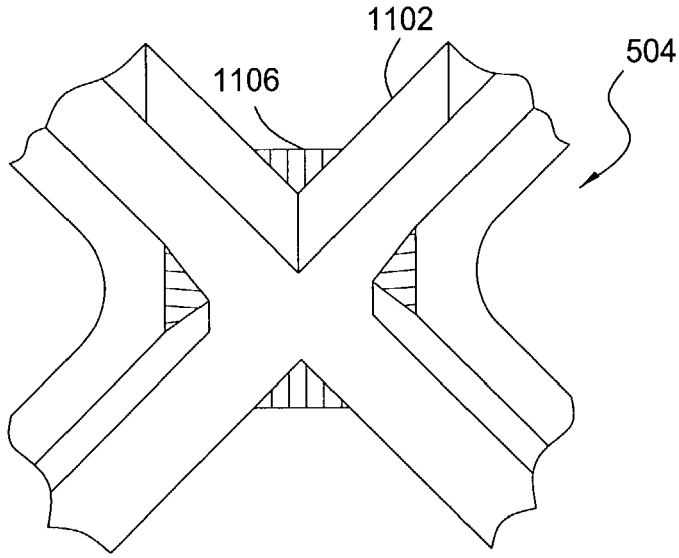
FIG. 11 is a perspective view of the intersection of four islands of an XY patterned polishing article having continuous contoured surfaces at the corners of the islands.

In contrast, FIG. 11 shows a portion of an embodiment of the polishing article 504 in which the contoured surfaces form discrete areas on the polishing article. Specifically, the contoured surfaces are in the form of inclined surfaces 1106 located at each of the corners of the islands 1102.

It should be noted that the foregoing embodiments are merely illustrative. As such, the contoured surface of the patterned polishing article surface may have any geometric shape. In addition, the contoured surfaces may be formed by any technique, whether known or unknown. Illustrative techniques include cutting, milling, molding and the like.

In one embodiment, the patterned polishing article 504 is used to polish a wafer surface generally comprising a dielectric layer with feature definitions formed therein, a barrier layer deposited generally on the dielectric layer, and a conductive material, such as a copper-containing material, deposited on the barrier layer. As used herein, the terms "copper-containing material", "copper" and the symbol Cu encompass high purity elemental copper as well as doped copper and copper-based alloys, e.g., doped copper and copper-based alloys containing at least about 80 wt. % copper. The barrier layer material may include tantalum, tantalum nitride, and derivatives thereof, such as tantalum silicon nitride. The use of other barrier materials known or unknown is also contemplated.

The dielectric layer can comprise any of various dielectric materials known or unknown that may be employed in the manufacture of semiconductor devices. For example, dielectric materials, such as silicon dioxide, phosphorus-doped silicon glass (PSG), boron-phosphorus-doped silicon glass (BPSG), and carbon-doped silicon dioxide, can be employed. The polishing articles and groove formations of the present invention are believed to be particularly advantageous where the material being removed is relatively soft, such as low-k dielectrics. A low-k material typically refers to a material having a dielectric constant less than silicon dioxide. Illustrative low dielectric constant materials include fluoro-silicon glass (FSG), polymers, such as polymides, carbon-containing silicon oxides, such as Black Diamond™ dielectric materials, available from Applied Materials, Inc. of Santa Clara, Calif., and silicon carbides, such as BLOk™ dielectric materials, available from Applied Materials, Inc. of Santa Clara, Calif.

While the foregoing is directed to embodiments of the present invention, other and further embodiments of the invention may be devised without departing from the basic scope thereof, and the scope thereof is determined by the claims that follow.

What is claimed is:

1. A chemical mechanical polishing article, comprising:
a body; and
a patterned surface comprising a plurality of slurry distribution grooves and a plurality of islands on the body, each of the plurality of the islands comprising:
an upper polishing surface;
one or more sidewalls defining at least a portion of the plurality of slurry distribution grooves, wherein the sidewalls of each of the plurality of islands extend orthogonally from a floor of the plurality of grooves; and
a contoured surface disposed between the upper polishing surface and the sidewalls.

2. The polishing article of claim 1, wherein the contoured surface is selected from the group consisting of an inclined surface, a rounded surface, and combinations thereof.

3. The polishing article of claim 1, wherein the slurry distribution grooves define a pattern selected from of the group consisting of concentric circles, spiraling grooves, serpentine grooves, linear grooves, and combinations thereof.

4. The polishing article of claim 1, wherein each of the plurality of islands are polygonal and the contoured surface of each of the plurality of islands is located at each corner of each of the plurality of islands and is discontinuous about the perimeter.

5. The polishing article of claim 1, wherein each of the plurality of islands comprise a shape selected from the group consisting of a circle and a polygon.

6. The polishing article of claim 5, wherein the contoured surface is selected from the group consisting of an inclined surface, a rounded surface, and combinations thereof.

7. The chemical mechanical polishing article of claim 1, wherein the contoured surface of each of the plurality of islands extends between the upper polishing surface and the upper ends of the one or more sidewalls.

8. The chemical mechanical polishing article of claim 1, wherein the body further comprises a platen mounting surface on a face of the body opposite the patterned surface.

9. A method of polishing materials disposed on a substrate, comprising:
contacting a patterned surface of a chemical mechanical polishing article with material disposed on a substrate surface, wherein the patterned surface comprises a plurality of slurry distribution grooves and a plurality of the islands on the body, each of the plurality of the islands comprising:
an upper polishing surface;
one or more sidewalls defining at least a portion of the plurality of slurry distribution grooves, wherein the sidewalls of each of the plurality of islands extend orthogonally from a floor of the plurality of grooves; and a contoured surface disposed between the upper polishing surface and the sidewalls; and providing relative motion between the patterned surface and the substrate.

10. The method of claim 9, wherein the material comprises at least one of the group consisting of a low k dielectric, copper, and combinations thereof.

11. The method of claim 9, wherein the contoured surface is selected from the group consisting of an inclined surface, a rounded surface, and combinations thereof.

12. The method of claim 9, further comprising flowing a slurry between the chemical mechanical polishing article and the material disposed on the substrate.

13. The method of claim 9, wherein the relative motion is selected from the group consisting of relative rotational motion, relative linear motion, intermittent motion, and combinations thereof.

* * * * *